US006766913B2

(12) United States Patent
Steen et al.

(10) Patent No.: US 6,766,913 B2
(45) Date of Patent: Jul. 27, 2004

(54) SADDLE SUPPORT DEVICE

(75) Inventors: Irwin Steen, Box 55, Kenville, Manitoba (CA), R0L 0Z0; David Steen, Balmoral (CA)

(73) Assignee: Irwin Steen, Manitoba (CA)

( * ) Notice: Subject to any disclaimer, the term of this patent is extended or adjusted under 35 U.S.C. 154(b) by 0 days.

(21) Appl. No.: 10/097,723

(22) Filed: Mar. 15, 2002

(65) Prior Publication Data

US 2002/0130097 A1 Sep. 19, 2002

(30) Foreign Application Priority Data

Mar. 16, 2001 (CA) ..... 2341290

(51) Int. Cl.[7] ..... A47F 7/00

(52) U.S. Cl. ..... 211/85.11; 211/87.01; 211/193; 224/402; 224/403

(58) Field of Search ..... 211/85.11, 86.01, 211/87.01, 193, 204; 224/402, 403

(56) References Cited

U.S. PATENT DOCUMENTS

| | | | | | |
|---|---|---|---|---|---|
| 3,305,101 | A | | 2/1967 | Mills | |
| 3,780,971 | A | * | 12/1973 | DeFilipps | |
| 4,253,578 | A | * | 3/1981 | Rekow | 211/208 |
| 4,405,170 | A | * | 9/1983 | Raya | |
| D279,829 | S | * | 7/1985 | Bartholomew | |
| 4,541,535 | A | | 9/1985 | Bartholomew | |
| 4,659,131 | A | * | 4/1987 | Flournoy | 296/3 |
| D294,753 | S | * | 3/1988 | Otterbein | |
| 4,932,540 | A | * | 6/1990 | Pfeifer | 211/193 X |
| 4,958,594 | A | * | 9/1990 | Swagerty | |
| 5,101,985 | A | | 4/1992 | Pasban-Dowlatshahi | |
| 5,590,795 | A | | 1/1997 | Wright | |
| 5,628,540 | A | * | 5/1997 | James | 211/189 X |
| 5,662,254 | A | * | 9/1997 | Lamajeur et al. | 224/405 X |
| 5,791,668 | A | * | 8/1998 | Lenardson | |
| 6,158,798 | A | * | 12/2000 | Stedtfeld et al. | |
| 6,206,207 | B1 | | 3/2001 | Kelly | |

* cited by examiner

*Primary Examiner*—Robert W. Gibson, Jr.
(74) *Attorney, Agent, or Firm*—Ryan W. Dupuis; Adrian D. Battison; Michael R. Williams

(57) ABSTRACT

A supporting device is provided for supporting a saddle on a truck having a truck box with a plurality of stake pockets formed along respective sides of the box. The supporting device comprises a post arranged to be slidably mounted within one of the stake pockets of the truck and a support frame extending laterally outwardly from one side of the post which is suitably arranged to support the saddle thereon. The slidable mounting of the saddle supporting device within one of the stake pockets provides a support for supporting a saddle thereon regardless of where the saddle is being used. The device is thus portable with the truck to provide a suitable supporting surface for a saddle even when away from the stable or related area where the horses upon which the saddle is to be used are normally kept. A suitable bracket may also be provided for supporting the post on a wall or other related supporting surface.

18 Claims, 2 Drawing Sheets

SADDLE SUPPORT DEVICE

FIELD OF THE INVENTION

The present invention relates to a device for supporting a saddle thereon and more particular to a portable saddle supporting device.

BACKGROUND

The use of racks is known for supporting saddles thereon when not in use, for example when the horses upon which the saddles are to be used are at rest or are being groomed. Generally when using a horse away from the stable or area where it is normally kept, removal of the saddle from the horse requires the saddle to be undesirably supported on the ground or some other inconvenient supporting surface which is not intended to support a saddle thereon. This occurs because known racks, in general, are intended to be fixed to a stable wall or the like and are thus not well suited to portability.

SUMMARY

The present invention is concerned with certain improvements to saddle supporting devices.

According to one aspect of the present invention there is provided a supporting device for supporting a saddle on a truck having a truck box with a plurality of stake pockets formed along respective sides of the box, the supporting device comprising:

- a post arranged to be slidably mounted within one of the stake pockets of the truck; and
- a support frame extending laterally outwardly from one side of the post and spanning transversely to a longitudinal direction of the post, the support frame being suitably arranged to support the saddle thereon.

The slidable mounting of the saddle supporting device within one of the stake pockets provides a support for supporting a saddle thereon regardless of where the saddle is being used. The device is thus portable with the truck to provide a suitable supporting surface for a saddle even when away from the stable or related area where the horses upon which the saddle is to be used are normally kept.

There may additionally be provided a bracket arranged to be mounted on a supporting surface having a channel therein which is arranged to slidably receive the post of the supporting device for mounting the device on the supporting surface. The channel is preferably similar in dimensions to the stake pockets of the truck box so as to similarly be suitably sized for slidably receiving the post therein. The use of such a bracket enables the saddle supporting device to be used for supporting a saddle both when at the stable or when away from the stable.

There may be provided an arm extending laterally outwardly from the post transversely to the longitudinal direction of the post which mounts the support frame thereon. The support frame, and the corresponding saddle supported thereon, may thus be supported on the arm laterally spaced apart from the post and the corresponding side of the truck which may be supporting the post therein.

The support frame preferably includes a central portion extending laterally outward from the post and a pair of side portions extending downward and outwardly from respective opposing sides of the central portion so as to generally conform to the shape of a saddle.

The post is preferably rectangular in cross section having similar dimensions to that of the stake pockets. Forming the post of non-metallic material, for example wood, provides some protection to the truck from scratches and the like due to repeated insertion and removal of the post from the stake pockets of the truck.

BRIEF DESCRIPTION OF THE DRAWINGS

In the accompanying drawings, which illustrate an exemplary embodiment of the present invention.

DETAILED DESCRIPTION

Figure 2:
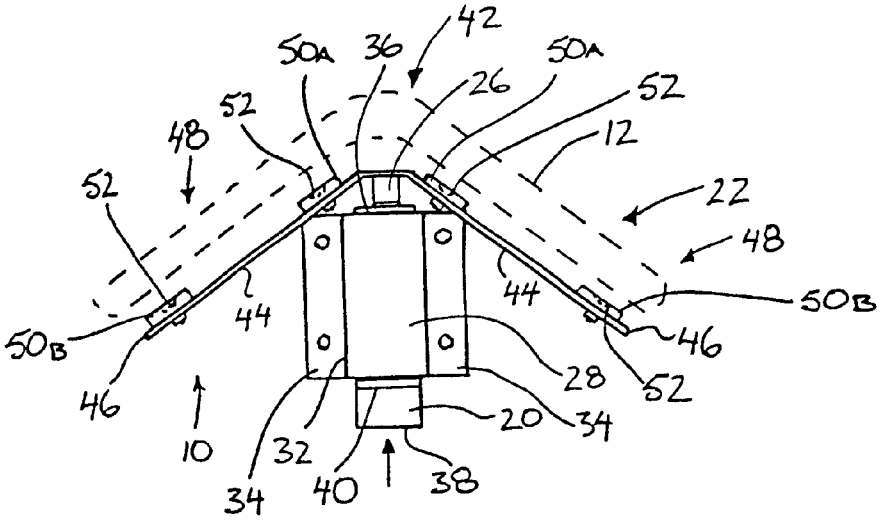
FIG. 2 is an elevational view of one end of the saddle supporting device of FIG. 1 shown supported on a wall mounting bracket.
Figure 3:
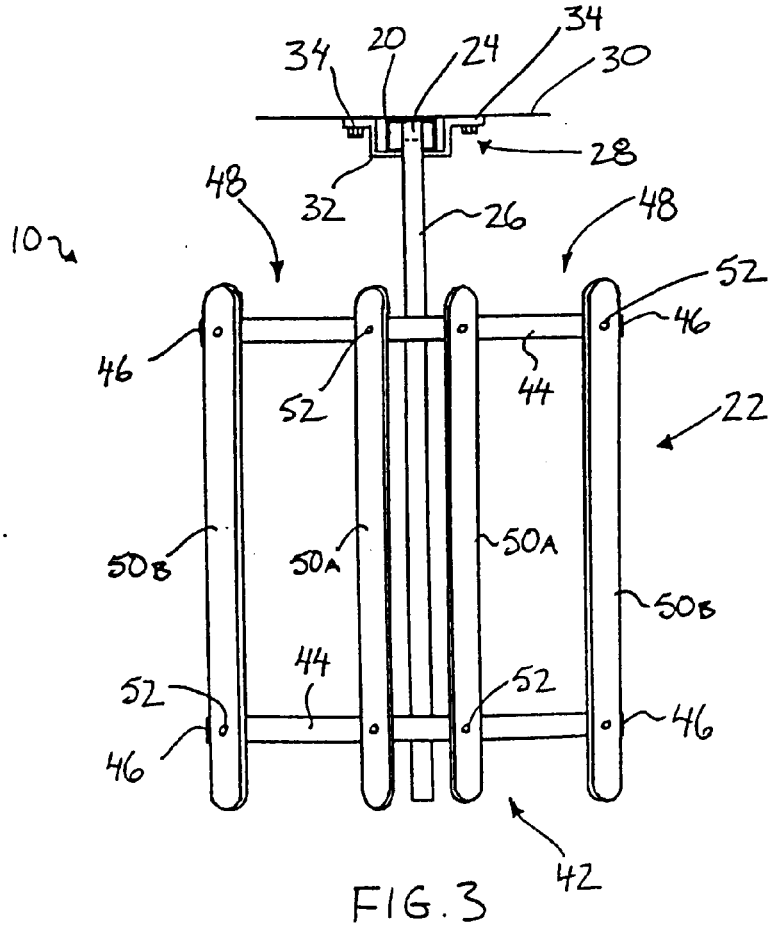
FIG. 3 is a top plan view of the saddle supporting device of FIG. 1, also shown supported on the wall mounting bracket.

Referring to the accompanying drawings, there is illustrated a saddle supporting device generally indicated by reference numeral 10. The device 10 is portable and intended for supporting a saddle 12 thereon as shown in dotted line in FIG. 2.

Figure 1:
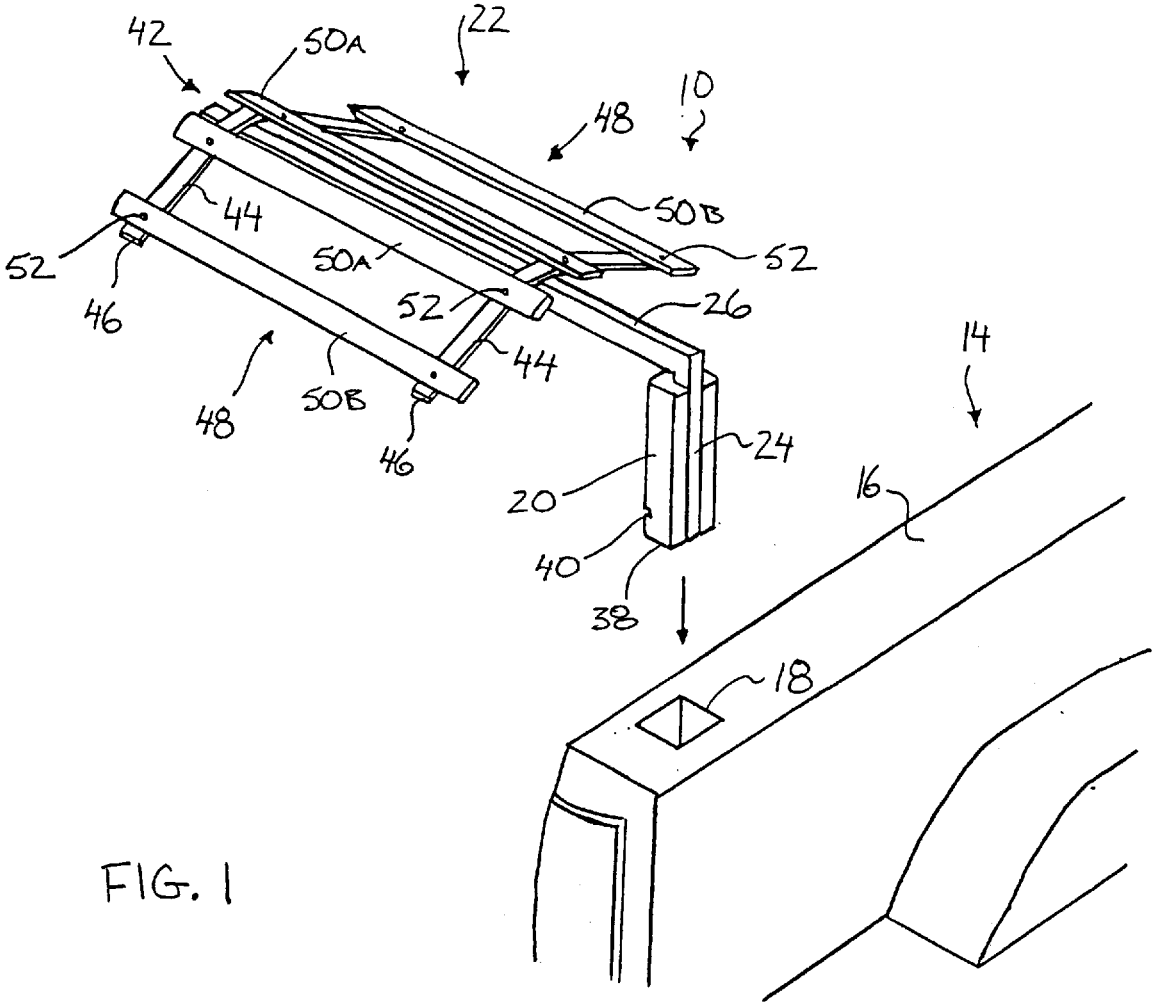
FIG. 1 is an isometric view of the saddle supporting device shown for use in mounting within the stake pockets of a truck box.

The saddle supporting device 10 is particularly useful with a truck 14 having a truck box with respective sides 16 as illustrated in FIG. 1. A plurality of stake pockets 18 are formed integrally at spaced locations along each of the sides 16 of the truck.

The device 10 includes a post 20 which is arranged for slidably mounting within one of the stake pockets 18 of the truck. A support frame 22 is coupled to the post 20 to extend laterally outward therefrom transversely to the longitudinal direction of the post. The support frame 22 is suitably shaped and sized to support the saddle 12 thereon.

The post 20 is an elongate member which is rectangular in cross section having similar dimensions to a standard size stake pocket 18 to securely receive the post 20 within the stake pocket while restricting relative rotation of the post about a longitudinal axis of the post in relation to the truck. The post 20 is formed of wood so as not to scratch the sides of the truck surrounding the stake pockets upon insertion and removal of the post from the stake pockets.

The post 20 includes a channel formed therein which extends longitudinally along one side of the post for receiving a support arm therein. The support arm includes a mounting portion 24 which extends longitudinally through the channel in the post 20 substantially the full length of the post and a supporting portion 26 which is coupled to a top end of the mounting portion 24 projecting upwardly past the top end of the post 20. The supporting portion 26 and the mounting portion 24 of the support arm are rigid members which are secured at right angles to one another such that the supporting portion 26 extends laterally outwardly from the post 20 at the top end of the post transversely to the longitudinal direction of the post. An inner end of the supporting portion 26 rests on the top end of the post 20 to provide additional support for the supporting portion 26 to extend outwardly from the side of the post 20 opposite from the channel formed therein.

A bracket 28 is provided for mounting the device 10 on a suitable upright supporting surface 30. The bracket 28 includes a U-shaped channel 32 having similar dimensions to a standard size stake pocket 18 for slidably mounting the post 20 within a square receptacle defined by the channel 32 when the channel is mounted adjacent the supporting surface 30. A pair of mounting flanges 34 extend laterally outwardly from opposing sides of the channel 32 and include respective mounting apertures therein for mounting the bracket 28 on the supporting surface using suitable fasteners.

When the device 10 is supported on the bracket 28, the supporting portion 26 of the support arm is arranged to rest on a top edge 36 of the channel 32. The post 20 is arranged to be longer than the channel 32 of the bracket such that a bottom end 38 of the post projects downwardly past a bottom end of the bracket. A rabbet 40 is formed in the post 20 in alignment with the bottom end of the bracket 28. The rabbet 40 permits a retainer member to be received therein once the post 20 has fully been inserted into the channel 32 of the bracket such that slidably removing the post may then be restricted by the retainer member.

The supporting portion 26 of the support arm projects laterally outwardly from one side of the post 20 for supporting a central portion 42 of the support frame thereon. The support frame 22 includes a pair of straps 44 which are mounted across a top side of the supporting portion 26 of the support arm. Each strap 44 extends perpendicularly to the support arm, being secured centrally on the top side of the support arm. The respective ends 46 of the straps 44 extend downwardly and outwardly from opposing sides of the respective support arm defining a pair of side portions 48 of the support frame 22 spanning outwardly from the central portion 42 so as to form an arch-shaped support frame which generally conforms to the shape of the saddle 12 to be supported thereon.

A plurality of auxiliary support members 50A and 50B are mounted to extend between the straps 44. Each of the support members extends longitudinally between the straps 44, spaced apart and parallel to the supporting portion 26 of the support arm, being mounted at respective ends on the respective straps. Each side portion 48 of the support frame 22 is thus formed by an inner support member 50A adjacent the support arm and an outer support member 50B which is adjacent the respective free ends of the straps 44.

The auxiliary support members 50A and 50B are formed of wood which has had all its sharp edges removed and corners rounded so as to provide no rough edges upon which the saddle 12 may be snagged. Fasteners 52 which mount the support members 50A and 50B to the respective straps 44, are recessed into an outer surface of the members to further remove any possible rough edges.

The support arm, the straps 44 and the bracket 28 are all formed of metal or other suitable rigid material to provide sufficient strength for supporting a saddle 12 thereon. The auxiliary support members 50A and 50B as well as the post 20 are also formed of rigid material, however they are preferably formed of a non-metallic material, for example wood, to reduce the possibility of scratching the truck 14 or snagging of the saddle thereon.

When supporting a saddle 12 in storage, the post 20 may be supported within the bracket 28 on a suitable supporting surface. When it is desirable to transport the saddle elsewhere, the post 10 may be removed slidably from the bracket 28 and then slidably inserted within one of the stake pockets on the truck for subsequently supporting the saddle 12 on the truck as desired. In one arrangement, the saddle supporting device 10 can be arranged such that the supporting portion 26 of the support arm extends laterally inwardly from the side of the truck box so as to span over the truck box to support the saddle 12 thereon spaced above the truck box. Alternatively the device 10 may be oriented such that the support frame 22 projects laterally outwardly or rearwardly from the truck box.

The straps 44, which define the support frame 22, are mounted at spaced apart positions along the supporting portion 26 from the post 20. The ends of the auxiliary support members 50A and 50B terminate adjacent the respective straps 44 mounting the support members thereon. The support frame 22 is thus spaced outwardly from the post and a corresponding side of the truck box supporting the device thereon. A saddle which is supported on the support frame 22 is thus also supported spaced outwardly from the sides of the truck to deter engagement of the saddle with the truck.

While one embodiment of the present invention has been described in the foregoing, it is to be understood that other embodiments are possible within the scope of the invention. The invention is to be considered limited solely by the scope of the appended claims.

What is claimed is:

1. A supporting device for supporting a saddle thereon in combination with a truck having a truck box with a plurality of stake pockets formed along respective sides of the box, the supporting device comprising:

a post slidably received within one of the stake pockets of the truck, the post having dimensions which are similar to dimensions of the stake pockets; and a support frame extending laterally outwardly from one side of the post and spanning transversely to a longitudinal direction of the post, the support frame being suitably arranged to support the saddle thereon.

2. The combination according to claim 1 wherein there is provided a bracket arranged to be mounted on a supporting surface, the bracket having a channel which is arranged to slidably receive the post therein for mounting the post on the supporting surface.

3. The combination according to claim 2 wherein the channel is similar in dimensions to the stake pockets of the truck box.

4. The combination according to claim 1 wherein there is provided an arm extending laterally outwardly from the post transversely to the longitudinal direction of the post which mounts the support frame thereon.

5. The combination according to claim 4 wherein the support frame is supported on the arm laterally spaced apart from the post.

6. The combination according to claim 1 wherein the support frame includes a central portion extending laterally outward from the post and a pair of side portions extending downward and outwardly from respective opposing sides of the central portion.

7. The combination according to claim 1 wherein the post is rectangular in cross section.

8. The combination according to claim 1 wherein the post is formed of non-metallic material.

9. A method of supporting a saddle, the method comprising:

providing a truck having a truck box with a plurality of stake pockets formed along respective sides of the box;

providing a supporting device including a post having dimensions similar to dimensions of the stake pockets and a support frame extending laterally outwardly from one side of the post, spanning transversely to a longitudinal direction of the post;

slidably receiving the post in one of the stake pockets of the truck box;

and supporting the saddle on the support frame of the supporting device.

10. The method according to claim 9 including providing a bracket having a channel formed therein, supporting the bracket on a supporting surface and slidably receiving the post in the channel of the bracket subsequent to slidably receiving the post in said one of the stake pockets.

11. The method according to claim 10 wherein the channel is similar in dimensions to the stake pockets of the truck box.

12. The method according to claim 9 including providing an arm extending laterally outwardly from the post, transversely to the longitudinal direction of the post, which mounts the support frame thereon laterally spaced from the post.

13. The method according to claim 9 wherein the support frame includes a central portion extending laterally outward from the post and a pair of side portions extending downward and outwardly from respective opposing sides of the central portion.

14. The method according to claim 9 including forming the post of non-metallic material which is rectangular in cross section.

15. A method of supporting a saddle the method comprising:

providing a supporting device including a post having dimensions similar to dimensions of a stake pocket in a side of a truck box of a truck and a support frame extending laterally outwardly from one side of the post, spanning transversely to a longitudinal direction of the post;

providing a bracket having a channel formed therein having dimensions similar to said stake pocket;

supporting the bracket on a supporting surface;

slidably receiving the post in the channel of the bracket;

supporting the saddle on the support frame of the supporting device; and slidably receiving the post in said stake pocket subsequently to slidably receiving the post in the channel of the bracket.

16. The method according to claim 15 including providing an arm extending laterally outwardly from the post, transversely to the longitudinal direction of the post, which mounts the support frame thereon laterally spaced from the post.

17. The method according to claim 15 wherein the support frame includes a central portion extending laterally outward from the post and a pair of side portions extending downward and outwardly from respective opposing sides of the central portion.

18. The method according to claim 15 including forming the post of non-metallic material which is rectangular in cross-section.

* * * * *